US006202764B1

(12) United States Patent
Ables et al.

(10) Patent No.: US 6,202,764 B1
(45) Date of Patent: Mar. 20, 2001

(54) STRAIGHT LINE, PUMP THROUGH ENTRY SUB

(76) Inventors: Muriel Wayne Ables, 1026 Walter Dr., Breaux Bridge, LA (US) 70517; Ronald Eugene Ables, 2208 Segura Rd., New Iberia, LA (US) 70560

( * ) Notice: Subject to any disclaimer, the term of this patent is extended or adjusted under 35 U.S.C. 154(b) by 0 days.

(21) Appl. No.: 09/144,860

(22) Filed: Sep. 1, 1998

(51) Int. Cl.[7] ..... E21B 19/08
(52) U.S. Cl. ..... 175/162; 166/77.1; 166/242.5
(58) Field of Search ..... 155/77.1, 84.2, 155/85.1, 85.3, 88.1, 88.4, 241.5, 242.2, 242.5, 242.6, 385; 175/202, 170, 162, 214, 45

(56) References Cited

U.S. PATENT DOCUMENTS 4,090,573 * 5/1978 Rankin ..... 175/45
4,877,095 * 10/1989 Wittrisch ..... 166/385
4,899,816 * 2/1990 Mine ..... 166/85
4,913,227 * 4/1990 Wittrisch ..... 166/117.5

* cited by examiner

*Primary Examiner*—David Bagnell
*Assistant Examiner*—Jeffrey Cader
(74) *Attorney, Agent, or Firm*—Jesse D. Lambert

(57) ABSTRACT

Entry sub for small conduit operations within the bore of a drill string. The entry sub comprises a central body having upper and lower collars, adapted for in-line attachment to a drill string. Each of the collars has a bore therethrough. The upper and lower collars are joined by dual connecting arms, the connecting arms separated so as to provide a cut-out section between the upper and lower collars. Fluid passages are contained within each connecting arm, connecting with the bores of the collars and providing a fluid flowpath through the length of the entry sub. A seal assembly is positioned in the bottom of the cut-out section, permitting a wireline or other small diameter conduit to pass therethrough into the bore of the lower collar and then into the bore of the drill string. A sheave is connected to the entry sub and positioned such that a wireline passing over the sheave enters the seal assembly substantially coincident with the axis of the drill string and positioned away from the wall of the bore of the lower collar and the drill string, thereby minimizing wear on the wireline and the entry sub. The axes of the collars being coincident with the axis of the drill string, no torque or bending moment is created between the entry sub and the drill string when the drill string is picked up with the entry sub connected in-line with the drill string.

14 Claims, 6 Drawing Sheets

FIG. 4
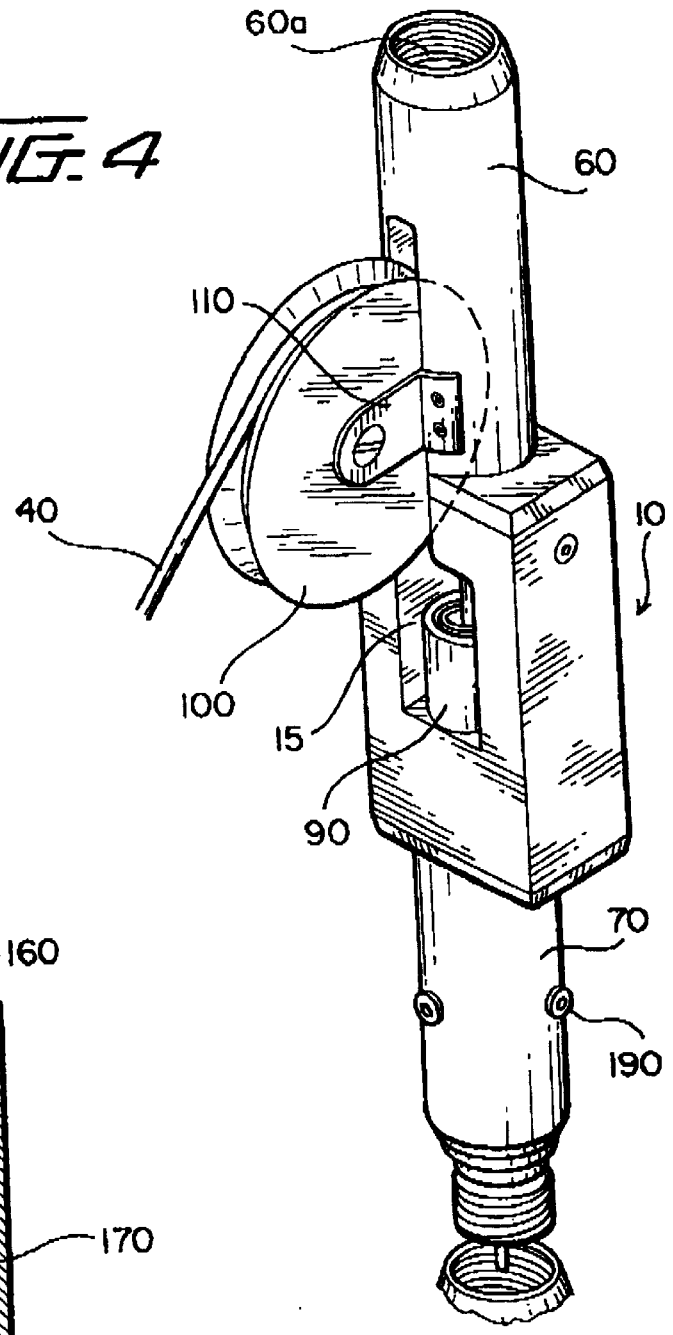
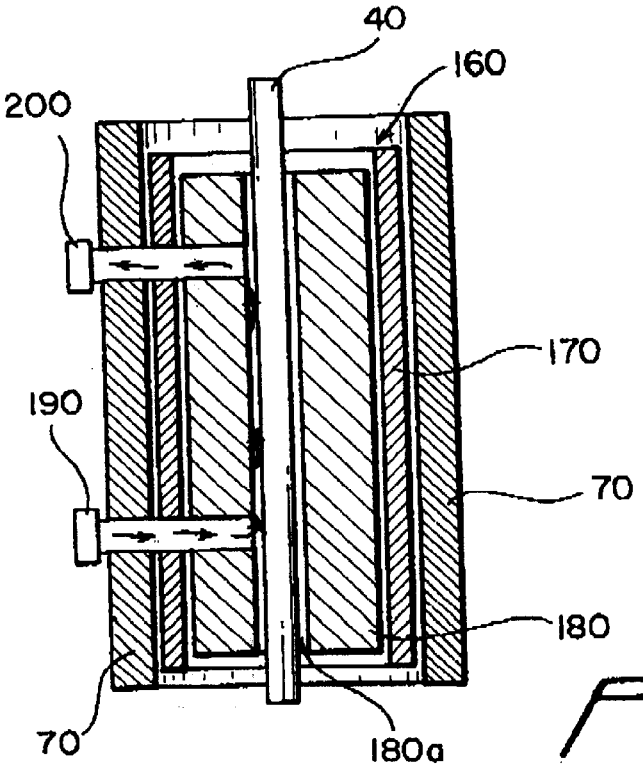
FIG. 7

STRAIGHT LINE, PUMP THROUGH ENTRY SUB

BACKGROUND

1. Field of Art

This invention relates to apparatus for running wireline, coiled tubing or other small diameter conduit inside of a larger tubular string, such as conventional drill pipe. With further particularity, this invention relates to an entry sub for pressure-controlled access to the interior of a drill string with a top drive unit in place, in which the apparatus is connected linearly with the drill string below a top drive unit, the wireline enters a seal assembly in the entry sub substantially aligned with the center axis of the drill string, the lift axis of the entry sub is concentric with the center axis of the drill string, and full pumping capability is retained through the top drive and drill string.

2. Related Art

At times, in the course of drilling oil and gas wells, it is necessary to run certain tools down through the inside of the drill string, with the drill string extending downhole. In this description, it is understood that the term "drill string" means, without limitation, the string of tubular members employed in drilling oil and gas wells, usually including drill pipe, drill collars, and possibly other downhole tools. Similar strings may be used in workover procedures as well.

One such situation is when a drill string becomes stuck during drilling operations. Diagnostic tools, commonly called "free point" tools, are run downhole within the bore of the drill string. Through manipulation of the drill string with the free point tool in place, the depth at which the drill string is stuck can be determined. Once the stuck point is determined, an explosive charge or "string shot" is run to a point above the stuck point, then discharged, loosening a drill string connection downhole and permitting the drill string to be backed off and a portion removed from the hole.

Other types of thru-drill string tools that are run on wireline include formation evaluation logging tools. In addition to wireline, it is occasionally desired to run coiled tubing downhole through the drill string. Although the following description discusses the running of wireline, it is understood that the discussion applies equally to other small diameter conduits such as, by way of example, coiled tubing.

Various tools have been employed to permit running small diameter conduits within a drill string, while retaining pressure control over the drill string. When running of such small diameter conduits, including wireline (whether "slickline" or electric line) and coiled tubing, the operational goals which such tools should satisfy include:

1) routing the wireline (or other small diameter conduit) from a spool or drum that is axially displaced from the center axis of the drill string, to a position substantially coincident with the center axis of the drill string, so that the wireline may run downhole with minimal rubbing contact on the interior of the tools and drill string (wearing both the drill string and the wireline);
2) maintaining a pressure seal about the wireline and thereby maintaining pressure control over the drill string;
3) preserving fluid pumping capability through existing rig equipment (for example a top drive unit or conventional drilling swivel), down through the drill string; and
4) permitting linear and rotary manipulation of the drill string without creating undesirable torque or bending moment forces in the drill string.

Various methods and apparatus exist in the related art for permitting running of wireline downhole within a drill string, while achieving perhaps some of the operational goals. Perhaps the oldest and simplest device is a "packoff assembly" which comprises a rubber sleeve with a hole therethrough, through which the wireline runs. The rubber sleeve is contained within a generally bowl-shaped body. A compression sleeve atop the rubber sleeve is threadably engaged with the bowl-shaped body, and is tightened to compress the rubber sleeve, in turn squeezing the rubber sleeve around the wireline and effecting a pressure seal. Other embodiments of the packoff assembly utilize a hydraulic actuated compression sleeve, which is forced downward onto the rubber sleeve by hydraulic force. Such packoff assemblies are typically made up in the uppermost box connection of a string of drill pipe, at a position above the rotary table. A number of drawbacks accompany such devices. The pressure capability is limited. Usually, a sheave must be mounted in the rig mast and aligned with the center axis of the drill string, with the wireline routed from a spool over that sheave and thence into the drill string. The hanging of the sheave is often problematic. With some packoff assemblies, it is not possible to maintain fluid pumping capabilities through the drill string, and those packoff assemblies that do provide for pumping usually employ a hose connected to a T-connection in the body of the packoff assembly, rather than being able to pump through the rig equipment (top drive and drill string). Significant restraints on fluid pressures and rates exist with such arrangements.

As a response to the significant limitations of the conventional packoff assembly, "entry subs" were developed. Two examples are disclosed in U.S. Pat. No. 4,681,162 to Boyd (Jul. 21, 1987) and U.S. Pat. No. 5,284,210 to Helms et al (Feb. 8, 1994). Both entry subs comprise a tubular member having a central body with lower threads for connection to the drill string. The central body has a bore which divides into first and second passages in its upper section, generally in a Y-shaped configuration. The first passage provides for threadable connection to the drill string above the entry sub (which may comprise a top drive unit or the like), while the second passage provides a means for introducing wireline, coiled tubing, or other small diameter conduit into the bore of the central body. A threaded connection at the upper end of the second passage provides a means for installing a pressure seal device around the wireline.

A common drawback to the entry subs disclosed in the Boyd and Helms et al references is that the wireline enters the entry sub at an angle to the center axis of the central body bore and of the drill string. As a result, the wireline bears against the low side of the interior of the entry sub, especially where the second "wireline" passage merges with the bore of the central body (in effect, where the wireline "turns the corner" from the angled second passage into the bore of the central body). Inevitably, wear occurs to both the wireline and the interior of the entry sub, and possibly to the drill string itself; recognizing such inevitable wear, both the Boyd and Helms et al entry subs have a replaceable section at the lower end of the entry sub where the majority of the wireline wear is expected.

Although an alternative embodiment in the Helms et al reference (FIG. 3 of the Helms et al '210 patent) provides a "straight line" entry of the wireline into the entry sub, such straight line wireline entry is accomplished at the expense of having an offset lift axis; that is, the drill string connection at the upper end of the Helms et al entry sub, in that embodiment, is offset from the center axis of the drill string.

Canting of the entry sub and drill string results from the torque and bending moment generated with an offset lift axis. It is to be noted that both embodiments of the Helms et al entry sub have a lift axis which is not coincident with the center axis of the drill string; therefore, due to creation of a bending moment, torque and canting of the drill string inevitably occurs.

Wittrisch, U.S. Pat. No. 4,913,227 (Apr. 3, 1990) discloses another entry sub which provides a pair of guide rollers to align the wireline with the center axis of the drill string. However, Wittrisch does not permit pumping through the entry sub via the top drive or drill string. Rather, a side opening is provided in the sub below the seal assembly, for connection to a "pumping installation" (which would necessarily comprise hoses or the like, with attendant rig-up problems, pressure limitations and the like).

OBJECTS AND ADVANTAGES

Accordingly, several of the objects and advantages of the present invention are:

a) to provide an entry sub which permits introduction of small diameter conduit, such as wireline or coiled tubing, into a drill string;

b) to provide an entry sub which retains pressure control over the drill string while small diameter conduit is worked into or out of the drill string;

c) to provide an entry sub which aligns the wireline with the center axis of the drill string prior to passage of the wireline into the entry sub, minimizing wear on the wireline and the entry sub which may be caused by the wireline bearing upon the interior of the entry sub;

d) to provide an entry sub which may be employed in conjunction with top drive units or conventional rotary drilling equipment, by being made up into the drill string below the top drive unit;

e) to provide an entry sub which may be used in conjunction with different numbers of sheaves, depending upon the specific operational situation at hand; and f) to provide an entry sub which has a lift axis which is substantially aligned with the center axis of the drill string to which it is connected, for prevention of bending moments and the resulting torque and canting.

Further objects are to provide an entry sub which is fast and easy to rig up and put into use during drilling operations, so as to minimize the time, for example, to determine the stuck point depth of a stuck drill string; and to provide an entry sub which is of relatively easy and economical manufacture. Further objects and advantages will become apparent from a consideration of the following description and drawings.

BRIEF DESCRIPTION OF THE FIGURES

FIG. 4 is a perspective view of the invention.

FIG. 7 is a detailed view of the flow tube assembly.

DESCRIPTION OF THE PREFERRED EMBODIMENT

Although many different embodiments of the invention are possible, with reference to the figures as appropriate (in particular, initially FIGS. 1 to 4), one embodiment is described below. It is understood that while the invention is described below in use with wireline (whether "slick line" or electric line), the invention is not limited to use with wireline, rather other small diameter conduits such as coiled tubing may be used as well.

Figure 1:
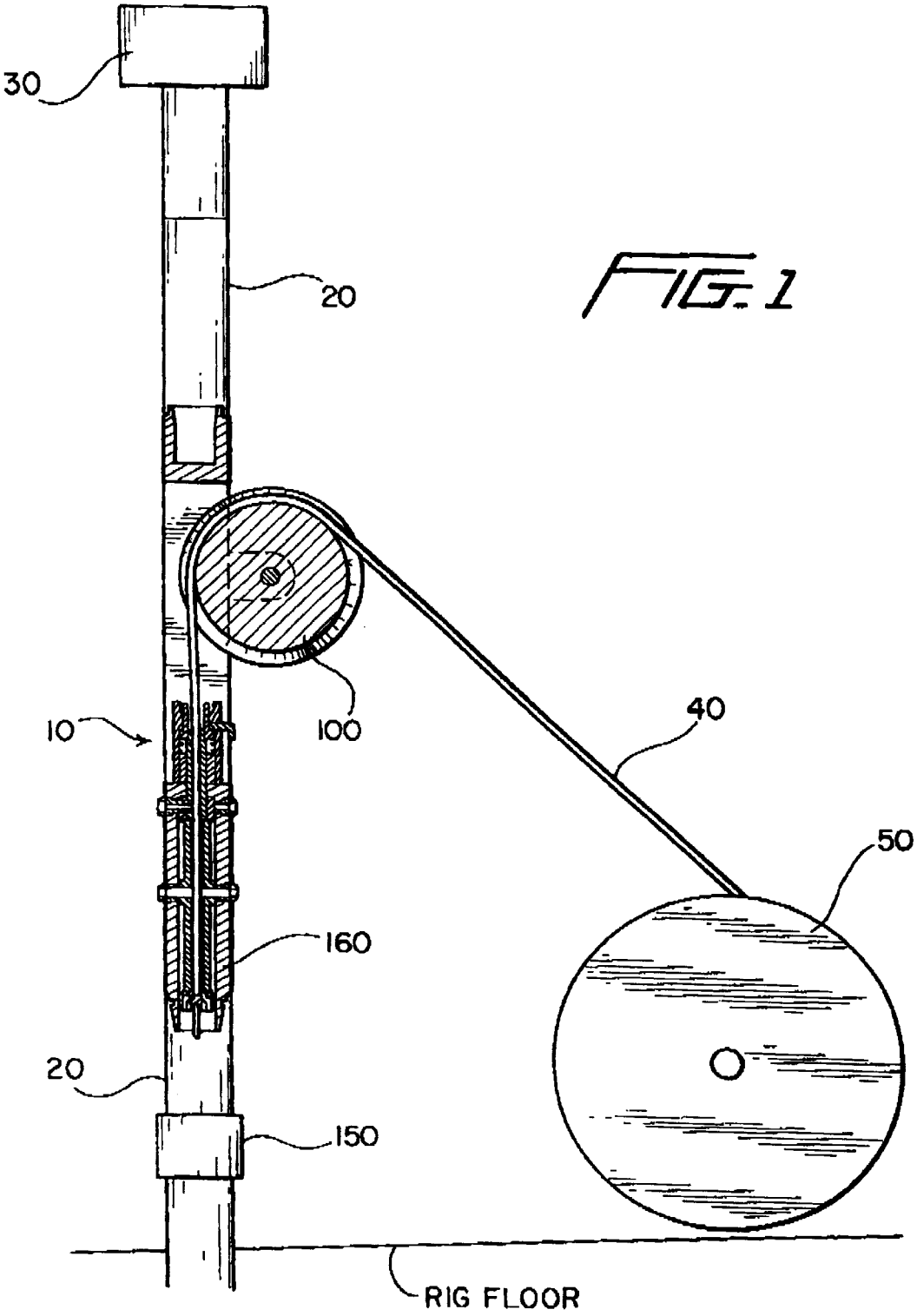
FIG. 1 is a side view schematic of one embodiment of the present invention, rigged up in a typical operational setting on a drilling rig floor.
Figure 3:
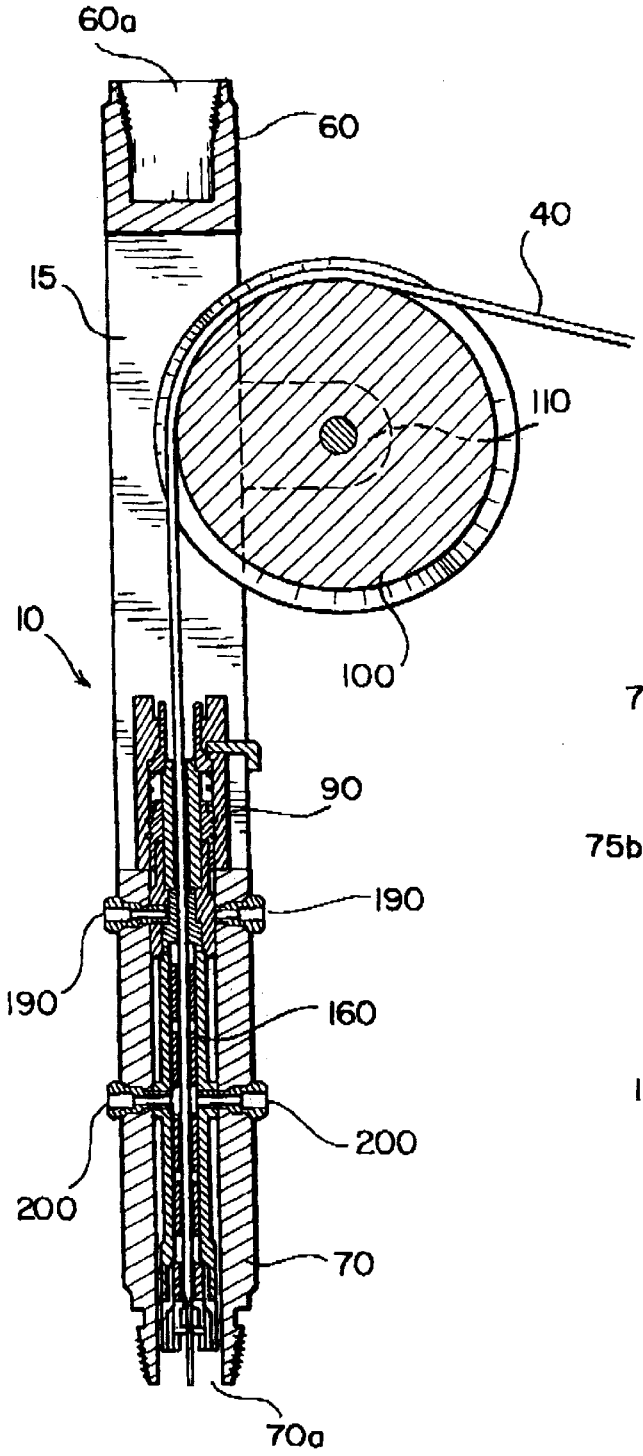
FIG. 3 is another detailed view of one embodiment of the present invention, turned approximately ninety degrees from FIG. 2, showing a single sheave in place.

FIG. 1 is a view of the entry sub 10 of the present invention in an operational setting, made up in a drill string 20 in conjunction with a top drive unit 30. A wireline 40 passes from a spool 50, over first sheave 100, into entry sub 10, and thence downhole.

Figure 2:
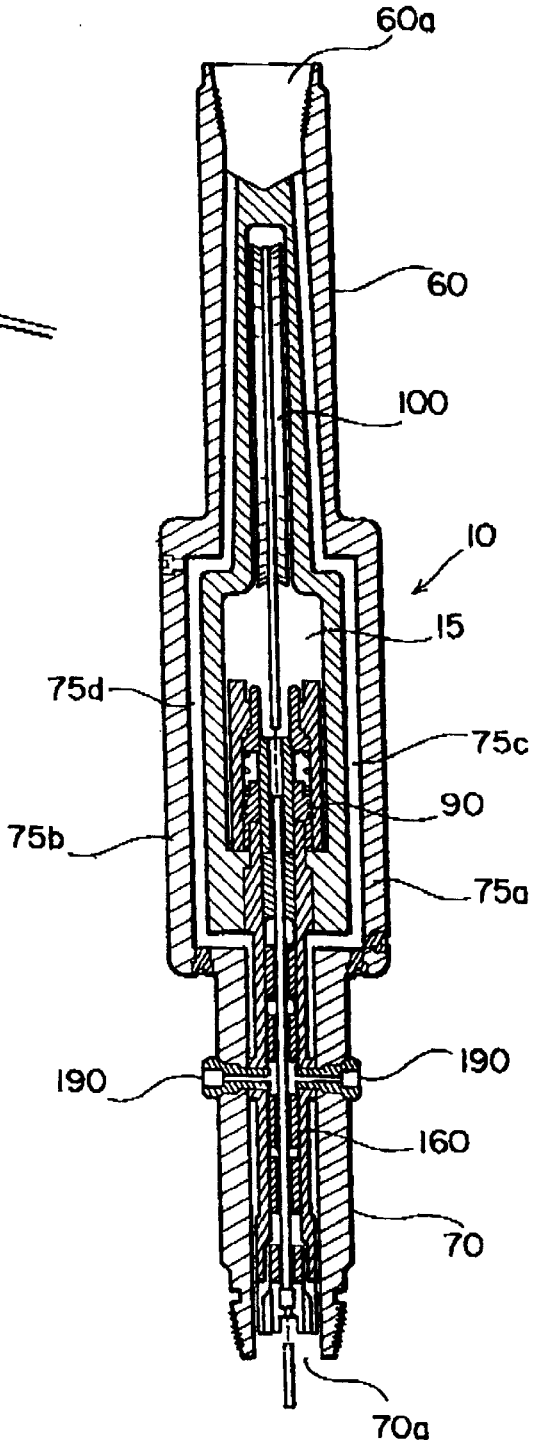
FIG. 2 is a detailed view of the entry sub of the present invention, in partial cross-section.

FIG. 2 is a detailed view of entry sub 10 in partial cross section. Entry sub 10 has a generally elongated tubular central body comprising an upper collar 60 and a lower collar 70, the collars joined by connecting arms 75*a* and 75*b*. Upper collar 60 has a bore 60*a* therethrough, while lower collar 70 has a bore 70*a* therethrough. Fluid passages 75*c* and 75*d* run through connecting arms 75*a* and 75*b*, and fluidly connect upper collar bore 60*a* and lower collar bore 70*a*. A flow-through fluid path therefore exists through the entire length of entry sub 10, which permits fluid circulation down through the entry sub and the drill string using the existing rig pumping equipment.

Upper and lower collars 60 and 70 are adapted to connect to drill string 20 above and below entry sub 10, and in the preferred embodiment have threaded connections to permit in-line threaded connection to drill string 20, typically below a top drive unit 30 on a drilling rig, as shown in FIG. 1. It is understood that other means of connection, well known in the art, may be employed. Upper and lower collars 60 and 70 have a common center axis that is not angled or displaced from the center axis of drill string 20, but instead is substantially coincident therewith, as shown for example in FIG. 1. When entry sub 10 is made up in drill string 20, the entirety of drill string 20 may be lifted by raising the top drive unit 30 with the rig drawworks. Accordingly, entry sub 10 is made of materials and has dimensions sufficient to give entry sub 10 sufficient tensile strength to lift drill string 20. By way of example only, entry sub 10 may be made of high strength carbon steel, stainless steel, or other similar materials. The "straight-line" aspect of the tool, that is, the center or lift axis of entry sub 10 being substantially coincident with the center axis of drill string 20, results in no undesirable bending moment or canting when drill string 20 is lifted with entry sub 10 in place.

Entry sub 10 has a cut-out section 15 between upper and lower collars 60 and 70. Mounted in the base of cut-out section 15 between upper and lower collars 60 and 70 is a seal assembly 90 for wireline passage therethrough into bore 70*a* of lower collar 70, and thence into the bore of drill string 20 leading downhole. The passageway through seal assembly 90, described in more detail below, is substantially concentric with the center axis of lower collar 70 and of drill string 20.

Figure 6:
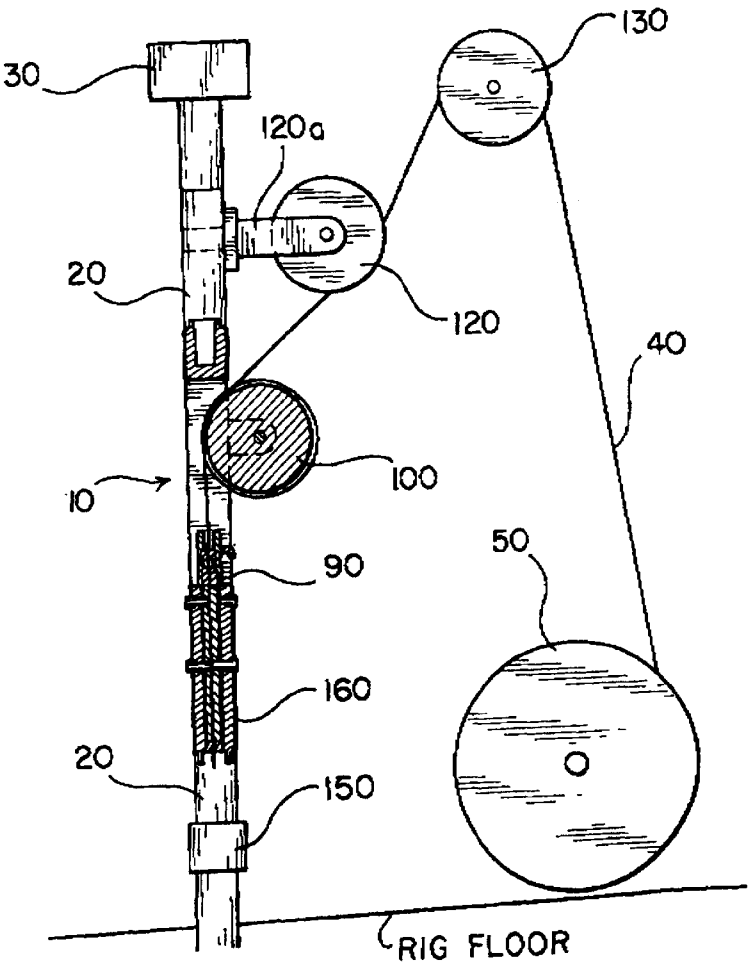
FIG. 6 is a side view of another embodiment of the present invention.
Figure 5:
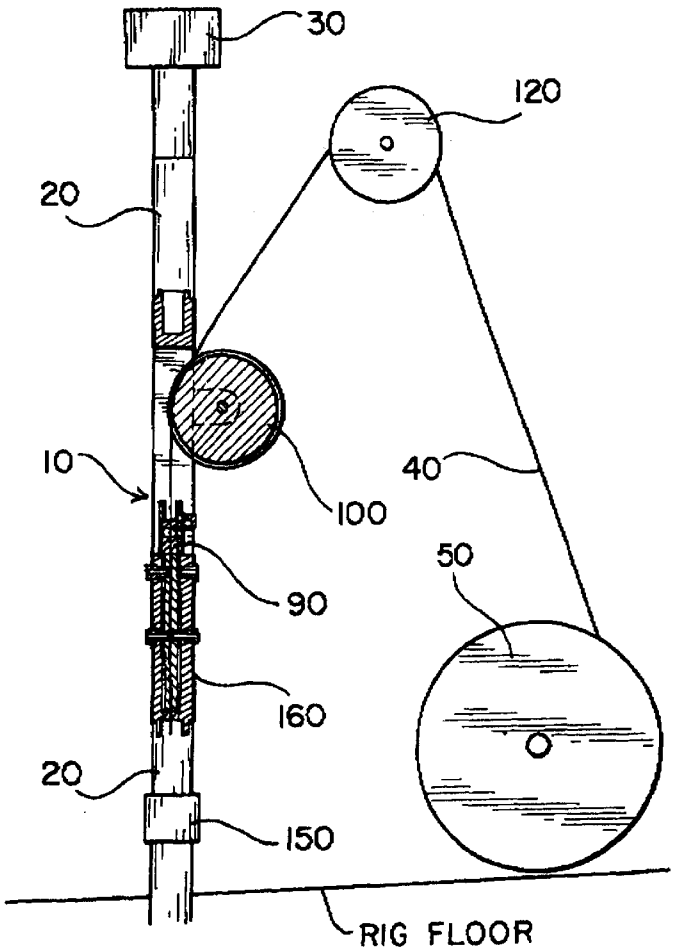
FIG. 5 is a side view of another operational setup employing the present invention.

FIGS. 1 through 4 additionally show a first sheave 100 connected to entry sub 10. In the preferred embodiment, first sheave 100 may be connected to entry sub 10 via a bracket 110 connected to entry sub 10. Wireline 40 passes over first sheave 100, through seal assembly 90 and through lower collar 70, and thence downhole. First sheave 100 is positioned such that wireline 40 coming off of first sheave 100 is substantially aligned with the center axis of both lower collar 70 and drill string 20, and therefore enters seal assembly 90 in a "straight line" position with respect to the center axis of drill string 20, as readily seen in FIGS. 2 and 3. In one embodiment, as shown in FIG. 6, wireline 40 then is routed over a second sheave 120 mounted on bracket 120*a*, and thence over a third sheave 130 to spool 50 of a wireline unit. Bracket 120*a* may be releasably mounted on upper collar 60 or on drill string 20, as illustrated. By way of example, such releasable mounting may be a chain clamp or other releasable means well known in the art.

A deployment of entry sub 10 is described in conjunction with the figures, in particular FIG. 6. FIG. 6 shows entry sub 10 made up in drill string 20, in typical use. As is seen, entry sub 10 is threadedly connected "in-line" with drill string 20. Entry sub 10 is mounted in drill string 20 below top drive unit 30. After connection of entry sub 10 to top drive unit 30 (using intermediate joints of drill pipe as necessary), wireline 40 from spool 50 is run over third sheave 130, which may be mounted at a convenient location in the rig mast laterally displaced from top drive unit 30. Wireline 40 thence runs over second sheave 120 and first sheave 100, through seal assembly 90, and out the lower end of lower collar 70. Wireline tools may then be connected to wireline 40 and lowered into drill string 20. A swivel 150 may be connected onto lower collar 70 of entry sub 10, with another short joint (or "pup joint") of drill pipe below it, which permits rotation of the threaded connection below entry sub 10 so as to threadably engage drill string 20 without turning entry sub 10. In addition, after entry sub 10 is threadably engaged in the drill string, it is frequently necessary to rotatably manipulate drill string 20 below entry sub 10 in order to transfer torque downhole, or back off a connection downhole; swivel 150 permits such rotary manipulation without turning entry sub 10. Additionally, a positive flow control valve (commonly known in the industry as a "TIW" valve) may be placed in drill string 20 below entry sub 10 and swivel 150, to permit pressure isolation of drill string 20 while entry sub 10 along with wireline and wireline tools are rigged up. Wireline unit containing spool 50 feeds wireline in or out as desired to position tools at a desired downhole depth.

By these figures, it may be seen that lift forces on drill string 20 with entry sub 10 in place are axial; that is, with entry sub 10 of the present invention, the lift axis of the entry sub is substantially coincident with the center axis of the drill string, and no torque or bending moments are transferred to drill string 20 upon lifting drill string 20 with entry sub 10 in place.

In certain operational situations where wireline operations are conducted under high pressure (by way of example only, pressures in excess of 200 psi), a flow tube assembly 160, shown in detail in FIG. 7, may be employed in lower collar 70, in addition to seal assembly 90. Flow tube assembly 160 has several functions. First, a flow tube assembly is capable of providing a pressure seal at higher pressures than is a seal assembly which comprises a resilient packoff element. Second, even in pressure situations that may be contained by a seal assembly, a flow tube assembly provides a leak free entry into high pressure wells with negligible wear on components. When pulling wireline out of the hole, by controlling the pressure at which grease is injected into the flow tube assembly, a "braking" effect can be applied to prevent wireline from being pushed out of the hole due to high pressures. When running into the hole with wireline, a flow tube assembly can provide a relatively low drag seal, in contrast to a conventional seal assembly which must utilize high contact forces (and consequently high friction and drag forces) to seal at high pressures, thus slowing wireline feed into the wellbore (and creating high wear on the seal assembly and possibly requiring frequent replacement, causing downtime and periods of non-pressure containment). In the preferred embodiment, as shown in FIG. 7, flow tube assembly 160 comprises flow tube sleeve 170, containing therein flow tube 180. Flow tube 180 has a bore 180*a* with a diameter slightly larger than the wireline diameter, by way of example about 0.004" larger. Flow tube 180 is typically of metal. A pressurized grease source supplies grease to a grease injection port 190 through which grease is pumped into the annulus between wireline 40 and the wall of bore 180*a*. Grease then flows out of said annulus through grease return port 200, and thence to a grease return tank. The grease supply pressure may be varied as described above to control well pressures and provide a more environmentally safe seal.

Figure 8:
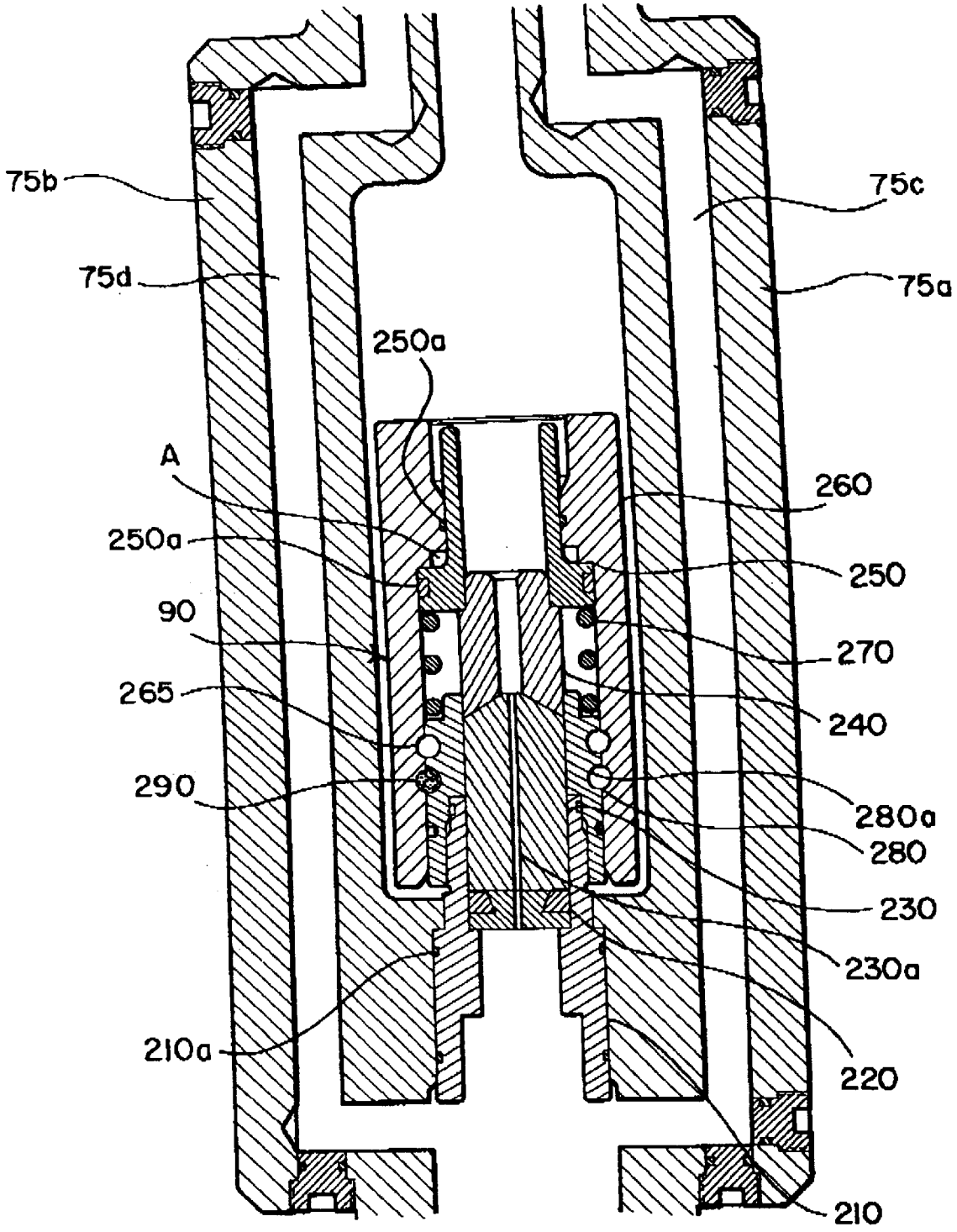
FIG. 8 is a detailed view of the packoff assembly.

While various types of seal assemblies may prove suitable for seal assembly 90, FIG. 8 is a detailed view of the preferred embodiment of seal assembly 90. Bottom sub 210 is disposed in the bottom of cut-out section 15, bottom sub 210 having a bore therethrough. Seals 210*a* provide a pressure tight seal between bottom sub 210 and the body of entry sub 10. A base plate 220 is situated within bottom sub 210. Packoff element 230 then is disposed atop base plate 220 and within the bore of bottom sub 210. A mandrel 240 bears against the top of packoff element 230. Packoff element 230 (which may be of a resilient material) has a longitudinal hole 230*a* therethrough, for wireline passage. A piston 250 in turn bears against mandrel 240, traveling within packoff housing 260. Seals 250*a* provide a pressure and fluid seal between piston 250 and packoff housing 260. A spring 270 biases piston 250 upward. A cylindrical connector 280 is threadably engaged on bottom sub 210. Packoff housing 260 is held onto cylindrical connector 280 by pins 290 (only one such pin being shown for clarity), inserted into holes 265 in packoff housing 260, engaging mating circumferential grooves 280*a* in cylindrical connector 280. This pin connection between packoff housing 260 and cylindrical connector 280 ensures proper positioning of packoff housing 260 with respect to cylindrical connector 280. Seal assembly 90 is operated by introducing hydraulic fluid into chamber A denoted on FIG. 8, which in turn forces piston 250 and mandrel 240 downward onto packoff element 230. Mating sloped surfaces between packoff element 230 and mandrel 240 force packoff element 230 to tightly "squeeze" a wireline (not pictured) passing through hole 230*a* in packoff element 230, effecting a pressure seal therearound.

Figure 9:
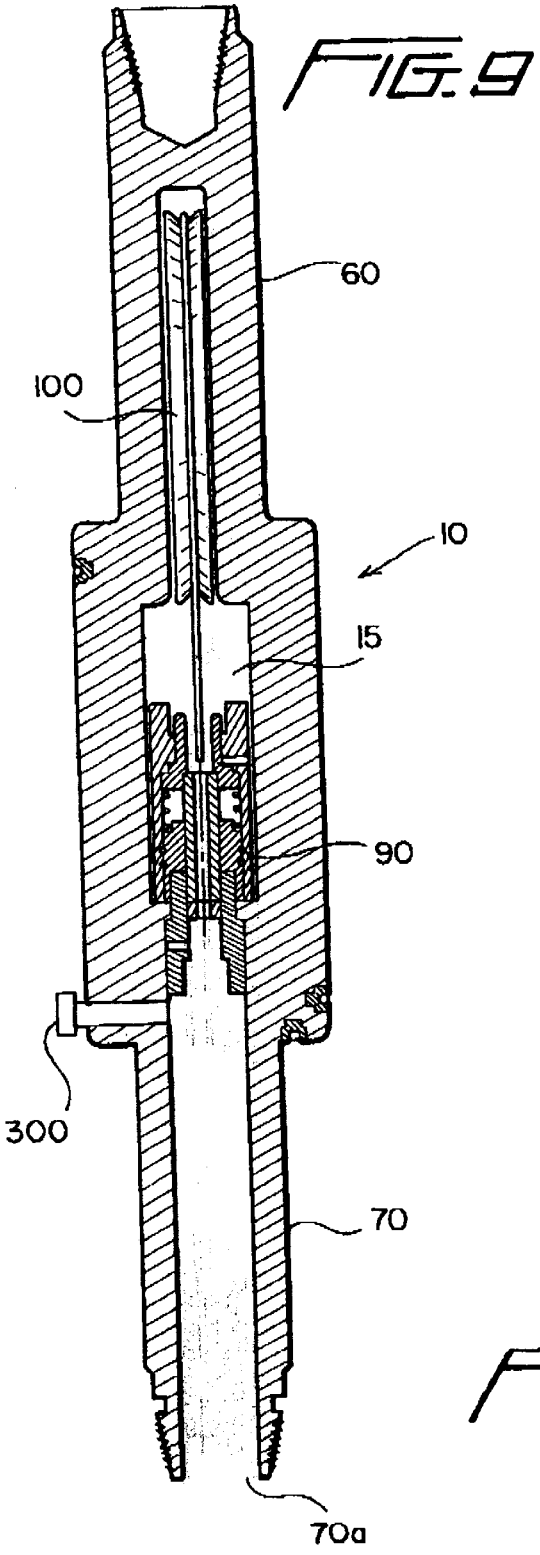
FIGS. 9 and 10 are a detailed views in cross section of another embodiment of the invention.
Figure 10:
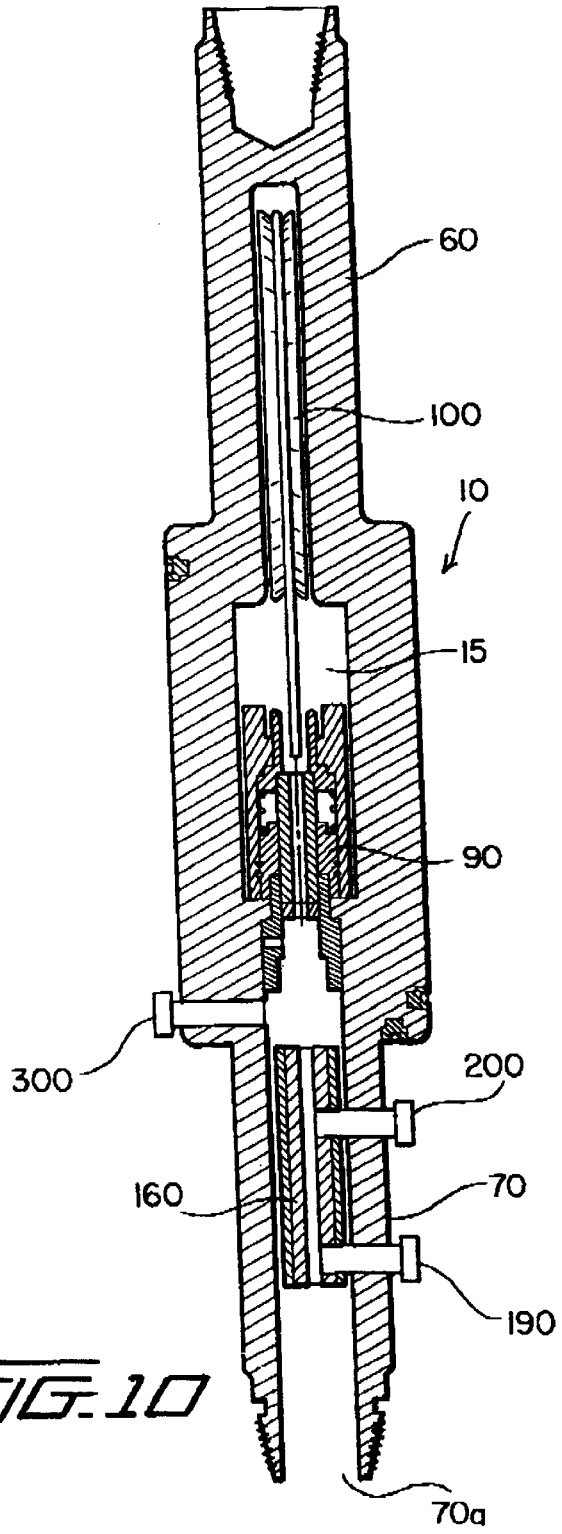

Another embodiment of the present invention is shown in FIG. 9. In this embodiment, like parts have the same reference numbers as the embodiment of FIG. 2, the primary difference being that this embodiment does not have fluid passages through connecting arms 75*a* and 75*b* connecting upper and lower collars 60 and 70. The "straight line" aspect is still present, with first sheave 100 positioned within cut-out section 15 so that wireline 40 enters seal assembly 90 substantially aligned with the axis of drill string 20; and the apparatus permits pickup of the entire drill string without undesirable canting of drill string 20. In this embodiment, pump-in capability to drill string 20 is achieved through port 300, to which piping, hosing or the like as appropriate may be connected. FIG. 10 shows the embodiment of FIG. 9, further comprising a flow tube assembly 160 disposed within lower collar 70, with grease injection and return ports 190 and 200.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

We claim:

1. An entry sub, comprising:

a) a central body comprising upper and lower collars, said upper and lower collars joined by two spaced apart connecting arms, said two spaced apart connecting arms forming a cut-out section in said central body intermediate said upper and lower collars, said upper and lower collars having longitudinal bores therein, each of said bores fluidly connected to fluid passages traversing each of said two connecting arms, thereby providing a fluid flowpath longitudinally through said central body, said upper and lower collars adapted for connection to a drill string such that a longitudinal axis of said upper and lower collars and a longitudinal axis of said drill string are substantially coincident;

b) a seal assembly mounted in said cut-out section so as to provide access to said bore of said lower collar, said seal assembly having a passage therethrough substantially coincident with said longitudinal axis of said lower collar, whereby a small diameter conduit can pass through said seal assembly and substantially centrally into said bore of said lower collar; and c) a first sheave mounted on said central body and positioned such that a small diameter conduit leaving said first sheave is substantially coincident with said passage through said seal assembly.

2. The entry sub of claim 1, further comprising a rotary swivel connected to said lower collar.

3. The entry sub of claim 2, further comprising a flow tube assembly disposed within said bore of said lower collar.

4. The entry sub of claim 3, wherein said flow tube assembly comprises a cylindrical flow tube sleeve held within said bore of said lower collar, said flow tube sleeve containing a flow tube with a bore substantially concentric with said longitudinal axis of said lower collar, and further comprising a grease injection port and a grease return port fluidly connecting said bore of said flow tube to an exterior of said lower collar.

5. The entry sub of claim 4, wherein said seal assembly is hydraulically actuated and comprises a cylindrical bottom sub containing a packoff element having a longitudinal hole therein, a cylindrical connector engaged on said bottom sub, a cylindrical packoff housing disposed over said cylindrical connector and fastened to said cylindrical connector by a plurality of pins inserted through holes in said packoff housing and engaging mating circumferential grooves in said connector, and a piston movable within said packoff housing in response to hydraulic force thereupon, said piston engaging said packoff element.

6. The entry sub of claim 5, further comprising a second sheave and a means for releasably connecting said second sheave to said drill string above said entry sub.

7. The entry sub of claim 1, further comprising a second sheave and a means for releasably connecting said second sheave to said drill string above said entry sub.

8. An entry sub, comprising:

a) a central body comprising upper and lower collars, said upper and lower collars joined by two spaced apart connecting arms, said two spaced apart connecting arms forming a cut-out section in said central body intermediate said upper and lower collars, said lower collar having a bore therein, said upper and lower collars adapted for connection to a drill string such that a longitudinal axis of said upper and lower collars and a longitudinal axis of said drill string are substantially coincident;

b) a seal assembly mounted in said cut-out section so as to provide access to said bore of said lower collar, said seal assembly having a passage therethrough substantially coincident with said longitudinal axis of said lower collar, whereby a small diameter conduit can pass through said seal assembly and substantially centrally into said bore of said lower collar, said lower collar further comprising a flow port below said seal assembly; and c) a first sheave mounted on said central body and positioned such that a small diameter conduit leaving said first sheave is substantially coincident with said passage through said seal assembly.

9. The entry sub of claim 8, further comprising a rotary swivel connected to said lower collar.

10. The entry sub of claim 9, further comprising a flow tube assembly disposed within said bore of said lower collar.

11. The entry sub of claim 10, wherein said flow tube assembly comprises a cylindrical flow tube sleeve held within said bore of said lower collar, said flow tube sleeve containing a flow tube with a bore substantially concentric with said longitudinal axis of said lower collar, and further comprising a grease injection port and a grease return port fluidly connecting said bore of said flow tube to an exterior of said lower collar.

12. The entry sub of claim 11, wherein said seal assembly is hydraulically actuated and comprises a cylindrical bottom sub containing a packoff element having a longitudinal hole therein, a cylindrical connector engaged on said bottom sub, a cylindrical packoff housing disposed over said cylindrical connector and fastened to said cylindrical connector by a plurality of pins inserted through holes in said packoff housing and engaging mating circumferential grooves in said connector, and a piston movable within said packoff housing in response to hydraulic force thereupon, said piston engaging said packoff element.

13. The entry sub of claim 12, further comprising a second sheave and a means for releasably connecting said second sheave to said drill string above said entry sub.

14. The entry sub of claim 8, further comprising a second sheave and a means for releasably connecting said second sheave to said drill string above said entry sub.

* * * * *